US006382861B1

(12) United States Patent
Chen et al.

(10) Patent No.: US 6,382,861 B1
(45) Date of Patent: May 7, 2002

(54) CLEANING DEVICE FOR CLEANING DIRT PRODUCED FROM MANUFACTURING EQUIPMENT

(75) Inventors: Ting-Kou Chen; Tu-Hao Yu; Chi-Yeh Huang; Yi-Yuan Chen, all of Hsinchu (TW)

(73) Assignee: Winbond Electronics Corp. (TW)

( * ) Notice: Subject to any disclaimer, the term of this patent is extended or adjusted under 35 U.S.C. 154(b) by 0 days.

(21) Appl. No.: 09/637,175

(22) Filed: Aug. 11, 2000

(30) Foreign Application Priority Data

Oct. 1, 1999 (TW) ..... 88116979

(51) Int. Cl.[7] ..... B43K 5/00

(52) U.S. Cl. ..... 401/203; 401/192; 401/199; 401/202; 401/204; 401/263

(58) Field of Search ..... 401/41–43, 192, 401/196, 198, 199, 202–205, 263, 283

(56) References Cited

U.S. PATENT DOCUMENTS

| | | | | | |
|---|---|---|---|---|---|
| 3,000,040 | A | * | 9/1961 | Carlson | 401/203 |
| 3,776,645 | A | * | 12/1973 | Walker | 401/203 |
| 3,814,526 | A | * | 6/1974 | Lotfallah | 401/199 |
| 5,324,127 | A | * | 6/1994 | Cortez | 401/202 |
| 5,661,869 | A | * | 9/1997 | Grout | 401/198 |
| 5,888,362 | A | * | 3/1999 | Fegan, Jr. | 401/198 |

* cited by examiner

*Primary Examiner*—Gregory L. Huson
*Assistant Examiner*—Tuan Nguyen

(57) ABSTRACT

A cleaning device for cleaning the dirt is disclosed. The cleaning device includes a container for receiving the cleaning material therein, a permeating element disposed in the container for introducing the cleaning material, and a cleaning head mounted on one end of the container and connecting with the permeating element for cleaning the dirt.

15 Claims, 1 Drawing Sheet

CLEANING DEVICE FOR CLEANING DIRT PRODUCED FROM MANUFACTURING EQUIPMENT

FIELD OF THE INVENTION

The present invention relates to a cleaning device for cleaning dirt, and more especially to a safe cleaning device when using corrosive chemical cleaning material to clean the dirt produced from manufacturing equipment.

BACKGROUND OF THE INVENTION

The highly corrosive cleaning material such as potassium hydroxide (KOH) or hydrochloric acid (HCI) solution is used for cleaning the dirt adhered to the surface of an ordinary or semiconductor manufacturing equipment. In the art, there is no well-designed cleaning machine or cleaning apparatus which can be safely and conveniently used to clean the dirt. In a general situation, the cleaner must put on the mask and anti-corrosive gloves to process the cleaning work by adhering the cleaning material in a dirt-free cloth or by directly slopping the cleaning material on the manufacturing equipment and then wiping off the dust with a dirt-free cloth. The highly corrosive cleaning material may splash out during the cleaning process which will be dangerous to the cleaner and consume lots of dirt-free cloths to finish the cleaning work. The cleaning process mentioned above not only wastes the cost of the dirt-free cloth but also bears high risk of causing face, skin or any contacted region of the cleaner to be hurt.

Seeing that the cleaning process is a must, an improved device for reducing the risk of using corrosive chemical cleaning material is desirable.

Therefore, it is attempted by the applicant to provide a cleaning device which can be safely used with the strong corrosive chemical cleaning material.

SUMMARY OF THE INVENTION

It is therefore an object of the present invention to provide a safe, convenient and recycling cleaning device such that the aforementioned drawbacks and dangerous situation for processing the cleaning work in the prior art can be overcome.

It is therefore another object of the present invention to provide a cleaning device for safely, conveniently and recyclingly storing strong chemical cleaning material such as potassiumn hydroxide (KOH) or hydrochloric acid (HCI) solution during the cleaning process.

It is therefore further an object of the present invention to provide a safe, convenient and recycling cleaning device which can prevent the cleaner from being splashed with a strong corrosive chemical cleaning material.

The safe, convenient and recycling cleaning device of the present invention comprises a container for receiving cleaning material therein, a permeating element disposed in said container for introducing cleaning material, and having a cleaning head mounted on one end of a container and connecting with a permeating element for cleaning the dirt.

According to the present invention, the cleaning device further comprises a connector disposed on the other end of the container opposite to one end and the connector can be further connected with a filling bottle by a method of connecting with a duct or directly putting the container into a filling bottle for supplying cleaning material to the container. The filling bottle as mentioned above is made of a soft and compressible material. Further, the connector comprises a one way valve for preventing cleaning material from leaking out of container which is made of a transparent material for allowing a user to inspect the cleaning material contained therein.

According to the present invention, the cleaning material is a strong corrosive solution which can be potassium hydroxide (KOH) or hydrochloric acid (HCI) solution.

According to the present invention, the cleaning device also comprises a cover detachably mounted on one end of the container for protecting the cleaning head, and the cover is made of a transparent material.

According to the present invention, the cleaning device has a retarder which can be a sponge disposed between the connector and the permeating element for absorbing cleaning material and preventing cleaning material from being introduced to the permeating element rapidly.

According to the present invention, the cleaning device comprises a cleaning head integrally formed and detachably connected with one end of the permeating element by a fixing element. And the fixing element is made of an anti-corrosive material such as the stainless steel material. Characteristically, the cleaning head can be formed at any geometric shape such as round shape, square shape, oblong shape or trapezoid shape for cleaning different shapes of cleaned objects. The cleaning head is made of the same material as that of permeating element, and the material can be Polyester, Polyamide or Polyurethane.

According to the present invention, the cleaning material in the cleaning device can travel from the permeating element to the cleaning head by capillarity.

According to the present invention, the cleaning device is offset pen-shaped or flexible.

It is therefore another object of the present invention to provide a cleaning device capable of bending and turning during the cleaning process, which comprises a main body for receiving a cleaning material and cleaning dirt by a cleaning head thereof, and a flexible element disposed in main body for allowing a user to bend main body.

It is therefore another object of the present invention to provide an anti-leaking cleaning device for cleaning the dirt, which comprises a main body for receiving a cleaning material and cleaning dirt by a cleaning head thereof, and a one-way valve disposed in the connector for preventing said cleaning material from leaking out of main body.

Furthermore, the object of the present invention is to provide a cleaning device which can be shrunken or enlarged in respect of the size on the demand of the environment when processing the cleaning work.

Also, the present device allows for a number of other advantages, which can be understood upon review with reference to the accompanying drawings the detailed descriptions which follow.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principle of the invention.

DETAILED DESCRIPTION OF THE PREFERRED EMBODIMENTS

Figure 1:
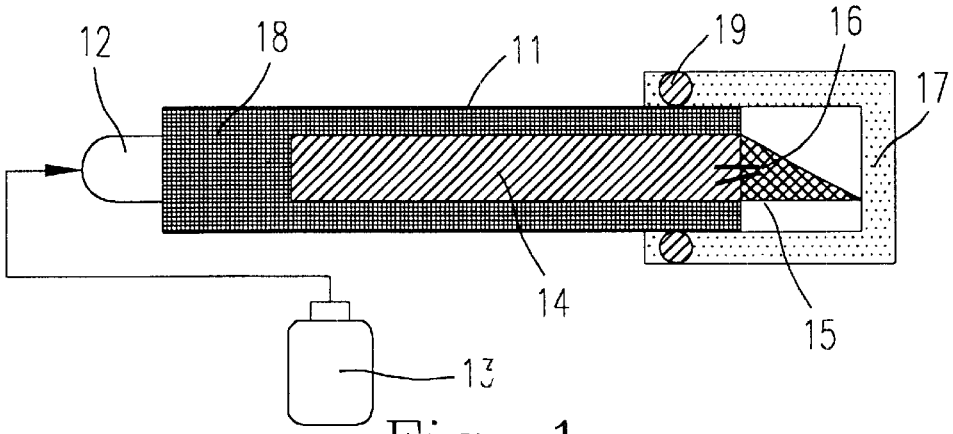
FIG. 1 is a schematic view showing substances and elements of a preferred embodiment of a cleaning device according to the present invention.

FIG. 1 is a schematical view showing substances and elements of a preferred embodiment of a cleaning device according to the present invention., As shown in FIG. 1, the cleaning device of the present invention includes a container 11, a permeating element 14 and a cleaning head 15. The container 11 has a connector 12 disposed on one end thereof and is connected with a filling bottle 13 via the connector 12 thereof. The filling bottle 13 is connected to the connector 12 of the container 11 by direct engagement therewith. Alternatively, the filling bottle 13 is connected to the connector 12 of the container 11 via a duct. And the filling bottle 13 is made of soft and compressible material for the cleaner's easily squeezing the cleaning material into the container 11. As can be seen in FIG. 1, the retarder 18, which can be a sponge material, is disposed between the connector 12 and the permeating element 14 for absorbing the cleaning material and preventing the cleaning material from being introduced to the permeating element 14 rapidly.

As shown in FIG. 1, a cleaning head 15 is integrally formed with one end of the permeating element 14. The cover 17 includes a griping annulus 19 to grip therewith the container 11 for protecting the cleaning head 15 from being scratched. Alternatively the cover 17 can be screwedgly engaged with the container 11.

The detailed procedure for a cleaning device processing the cleaning work is described as follows. When the cleaning material flows from the filling bottle 13 into the container 11, the cleaning material will travel from the permeating element 14 to cleaning head 15 by capillarity. Next, the permeating element 14 made of one of Polyester, Polyamide or Polyurethane material introduces the cleaning material such as potassium hydroxide (KOH) or hydrochloric acid (HCl) solution from high concentration area to low concentration area by capillarity. That is to say, after the cleaning head 15 contacting the dirt and releasing the cleaning material and then mixing with the solution produced from the cleaned object, the concentration of the cleaning material around cleaning head 15 will be reduced, and the cleaning material reserved in container 11 which remains in a high concentration state will keep on being introduced to the permeating element 14 for supplying the cleaning material to cleaning head 15 by capillarity. Hereinafter, we describe another situation which might occur. As the cleaning material is sent to the cleaning head 15 and contacts the cleaned object, the cleaning material is permeating from one end of the permeating element 14 opposite to the end near the cleaning head 15 by capillarity no matter whether the concentration of the cleaning material changes or not. Anyway, after the cleaning processing is continuously performed, the cleaning material will be run out and the exhausted cleaning material must be supplied by filling bottle 13. As the cleaning process described above, the cleaning device possesses a reusable and recycling advantage.

Because the cleaning material is strong, corrosive material, some of substances and elements of the cleaning device in the present invention, such as the container 11, permeating element 14, cleaning head 15 and fixing element 16, are made of anti-corrosive material. Mentioned particularly here, the fixing element 16 in the present invention can be a stainless steel material for preventing from being corroded.

The present invention also provides a see-through cleaning device for cleaner to inspect the chemical of the cleaning material, such as the cover 17 in FIG. 1 is made of a transparent material the same as that of the permeating element 14 for cleaners to protect the cleaning head, examine the volume of the cleaning material and inspect whether the quality of the cleaning material reserved in container 11 changes or not. As precipitating, impure or cloudy solution is produced in the cleaning material, the cleaner must renew the cleaning material.

Significantly, the cleaning head 15 in FIG. 1 can be formed in any geometric shape such as round shape, square shape, oblong shape and trapezoid shape for cleaner to clean the corner and the irregular shape of the cleaned objects and prevent the cleaned objects from being scratched.

Figure 2:
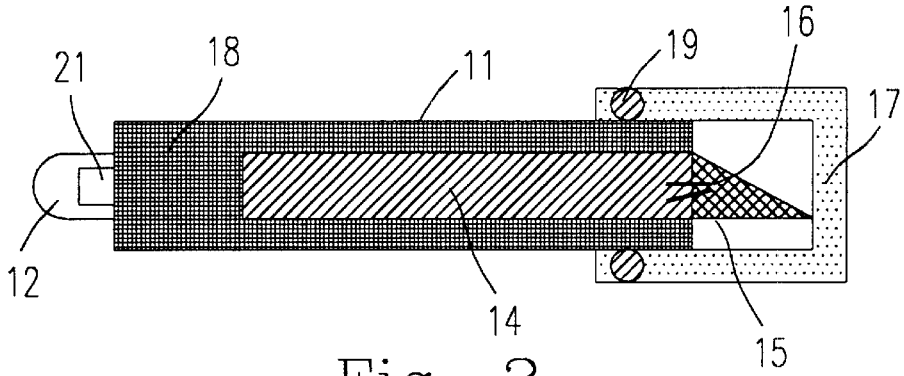
FIG. 2 is a schematic view showing a one-way valve of a cleaning device according to the present invention.

FIG. 2 schematically shows a one-way valve in the cleaning device. The one-way valve 21 disposed in the connector 12 provides the advantages for preventing the cleaning material from reflux or leaking out of container 11 when supplying the cleaning material into the cleaning device.

Figure 3:
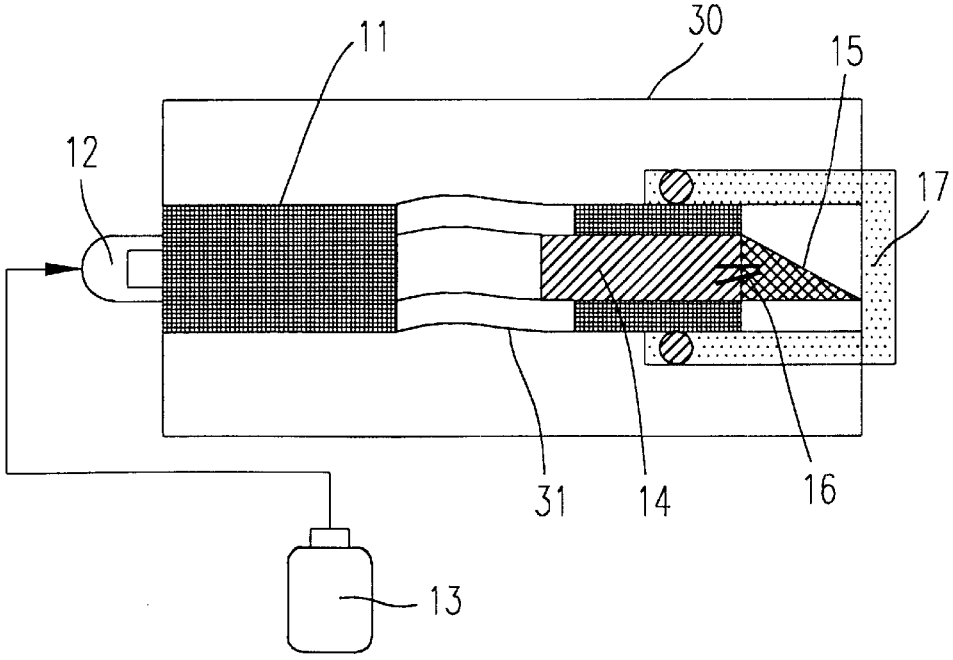
FIG. 3 is a schematical view showing a flexible element of another preferred embodiment of a cleaning device according to the present invention.

FIG. 3 is another preferred embodiment of the present invention showing the flexible element in the main body of the cleaning device. The flexible element 31 in FIG. 3 is disposed in main body 30 for a cleaner's easily bending and turning the cleaning device. The preferred embodiment of the cleaning device in FIG. 3 can be extensively put in application for cleaning differently angled surfaces, the corner and the irregular shape of cleaned objects. In other word, the flexible element can be made into any shape such as a slanting, a curved, a pen-shaped or an angled cleaning device for the user to clean various kinds of cleaned objects.

Accordingly, a safe, convenient and recycling cleaning device has been provided by the present invention. The present architecture provides for every cleaner to perform the cleaning work in a safe situation to clean the dirt produced from an ordinary or semiconductor manufacturing equipment.

Additional advantages and modification will readily occur to those skilled in the art. Therefore, the invention in its broad aspects is not limited to the specific details, and representative devices shown and described herein. Obviously many modifications and variations will be apparent to practitioners skilled in this art. It is intended that the scope of the invention be defined by the following claim and their equivalents.

What we claim is:

1. A cleaning device for cleaning the dirt, comprising:

a container for receiving a cleaning material therein, said container being made of a transparent and flexible material for enabling a user to inspect said cleaning material therein and to bend said container by applying an external force thereto;

a permeating element disposed in said container for introducing said cleaning material; and a cleaning head mounted on one end of said container and connecting with one end of said permeating element for cleaning said dirt, wherein said cleaning material is a strong corrosive solution selected from the group consisting of potassium hydroxide (KOH) and hydrochloric acid (HCl) solutions.

2. The cleaning device according to claim 1, further comprising a connector disposed on the other end of said container opposite to said one end.

3. The cleaning device according to claim 2, further comprising a filling, bottle connected to said connector by one of a duct and a direct engagement with said connector for supplying said cleaning material to said container.

4. The cleaning device according to claim 2, wherein said connector comprises a one way valve for preventing said cleaning material from leaking out of said container.

5. The cleaning device according to claim 1, further comprising a cover detachably mounted on said one end of said container for protecting said cleaning head.

6. The cleaning device according to claim 5, wherein said cover is made of a transparent material.

7. A The cleaning device according to claim 1, further comprising a retarder disposed between said connector and said permeating element for absorbing said cleaning material and preventing said cleaning material from being introduced to said permeating element rapidly.

8. The cleaning device according to claim 7, wherein said retarder is a sponge.

9. The cleaning device according to claim 1, wherein said cleaning head is detachably connected to said one end of said permeating element by a fixing element.

10. The cleaning device according to claim 9, wherein said fixing element is made of an anti-corrosive material including stainless steel.

11. The cleaning device according to claim 1, wherein said cleaning head is integrally formed with said one end of said permeating element.

12. The cleaning device according to claim 1, wherein said cleaning head is formed in any geometric shape selected from a group consisting of round shape, square shape, oblong shape and trapezoid shape.

13. The cleaning device according to claim 1, wherein said cleaning head is made of the same material as that of said permeating element selected from one of group consisting of Polyester, Polyamide and Polyurethane.

14. The cleaning device according to claim 1, wherein said cleaning material travels from said permeating element to said cleaning head by capillarity.

15. The cleaning device according to claim 1, wherein said container is elongated, and wherein said cleaning head is offset from a long axis of said container.

* * * * *